United States Patent [19]

Hensler

[11] Patent Number: 4,685,225

[45] Date of Patent: Aug. 11, 1987

[54] SKI BOOT

[75] Inventor: Adolf Hensler, Köflach, Fed. Rep. of Germany

[73] Assignee: Koflach Sportgerate Gesellschaft, Vienna, Austria

[21] Appl. No.: 802,208

[22] Filed: Nov. 25, 1985

[30] Foreign Application Priority Data

Nov. 23, 1984 [AT] Austria ..... 3717/84

[51] Int. Cl.[4] ..... A43B 5/04

[52] U.S. Cl. ..... 36/117; 36/120

[58] Field of Search ..... 36/117–121

[56] References Cited

U.S. PATENT DOCUMENTS

| | | | |
|---|---|---|---|
| 4,095,356 | 6/1978 | Robran et al. | 36/121 |
| 4,186,501 | 2/1980 | Salomon | 36/121 |
| 4,282,658 | 8/1981 | Hanson et al. | 36/121 |
| 4,381,613 | 5/1983 | Lederer | 36/121 |
| 4,455,768 | 6/1984 | Salomon | 36/121 |
| 4,577,420 | 3/1986 | Petrini et al. | 36/120 |

FOREIGN PATENT DOCUMENTS

| | | | |
|---|---|---|---|
| 329407 | 5/1976 | Austria . | |
| 0053340 | 6/1982 | European Pat. Off. . | |
| 0172159 | 2/1986 | European Pat. Off. | 36/117 |
| 3115529A1 | 1/1982 | Fed. Rep. of Germany . | |
| 2539278 | 7/1984 | France | 36/117 |
| 2555418 | 5/1985 | France | 36/117 |

*Primary Examiner*—James Kee Chi

*Attorney, Agent, or Firm*—Cushman, Darby & Cushman

[57] ABSTRACT

The ski boot has a shell (1) and a shaft (3) being swivellable relative to the shell (1). The shaft (3) has at least one recess (8) or groove extending transversely relative to the longitudinal direction of the boot and having placed therein rigid supporting elements (10) which are held and guided by a carrier element (9). (FIG. 1).

20 Claims, 24 Drawing Figures

FIG. 6
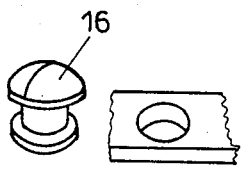
FIG. 7
FIG. 8
FIG. 5
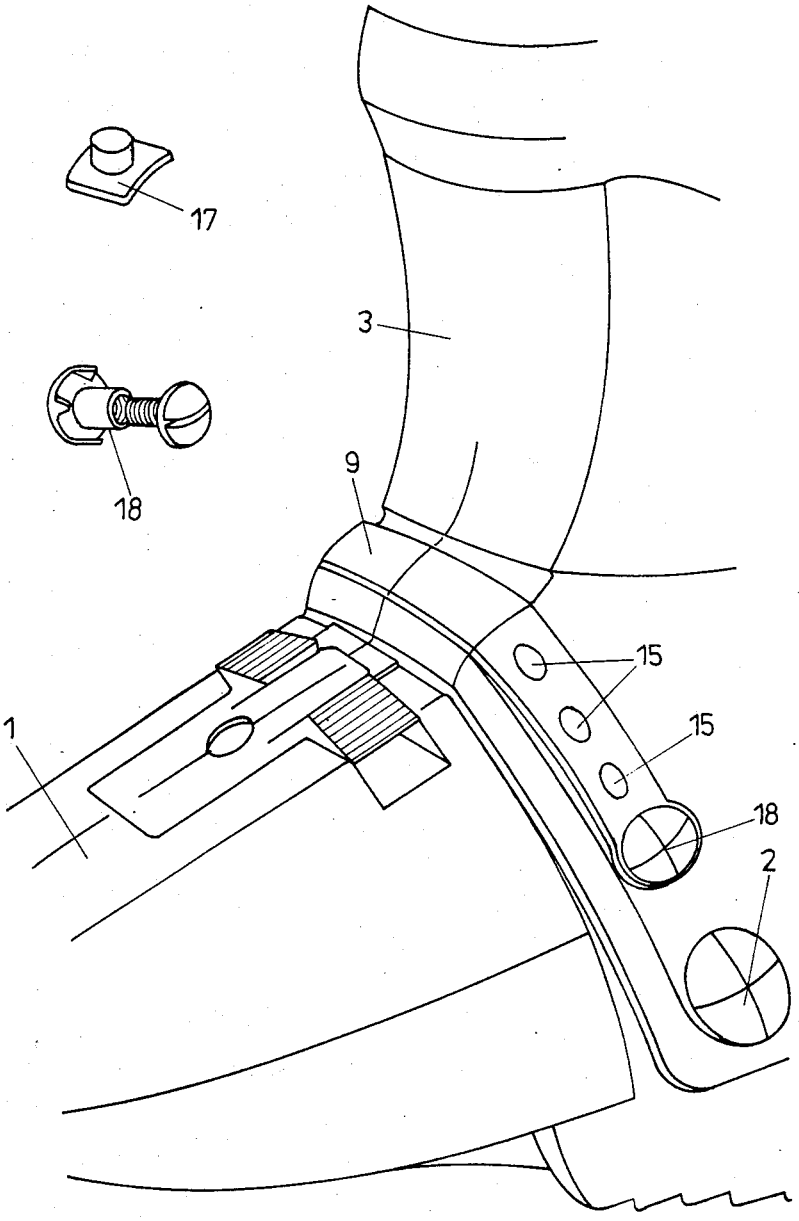

FIG. 12
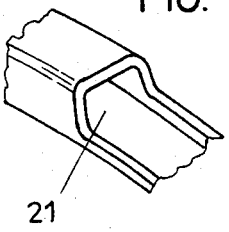
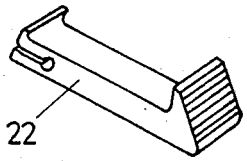
FIG. 13
FIG. 11
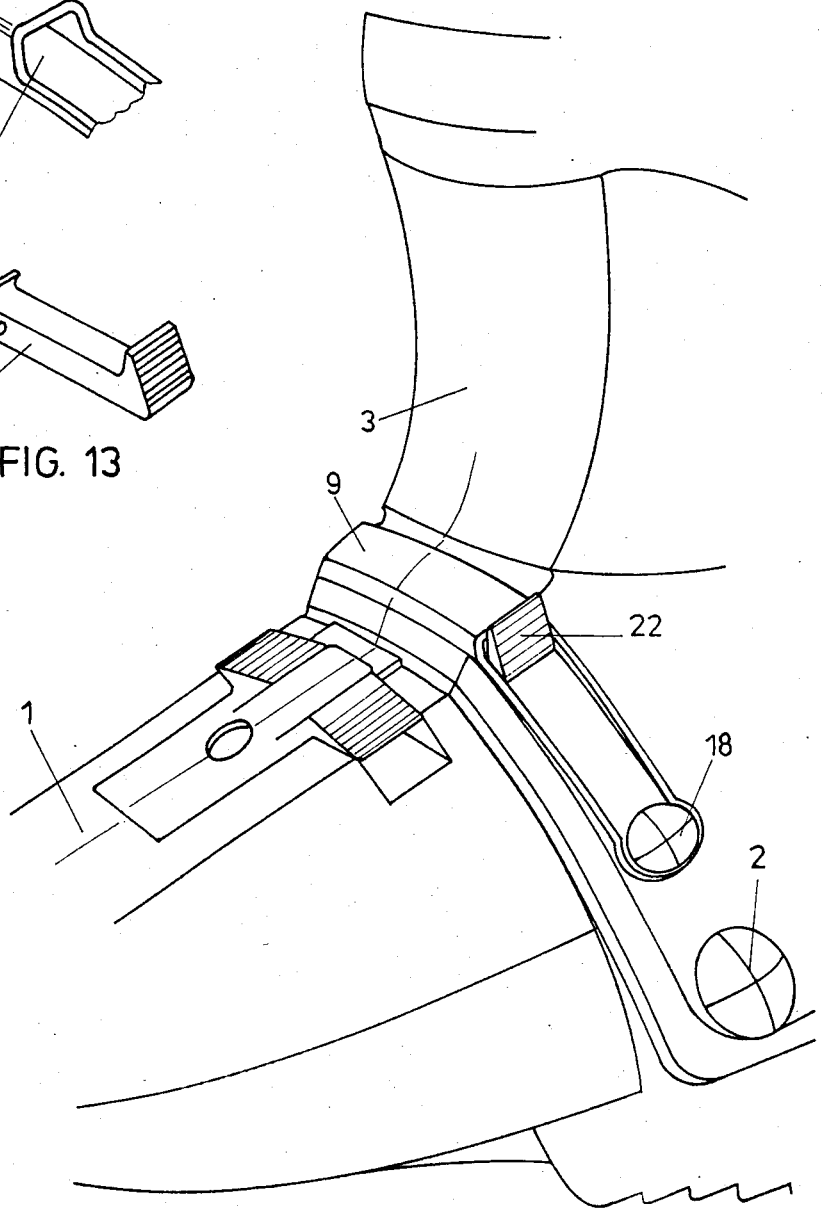

FIG. 17
FIG. 18
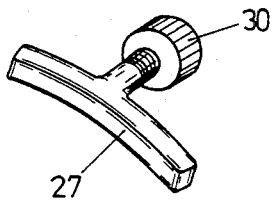
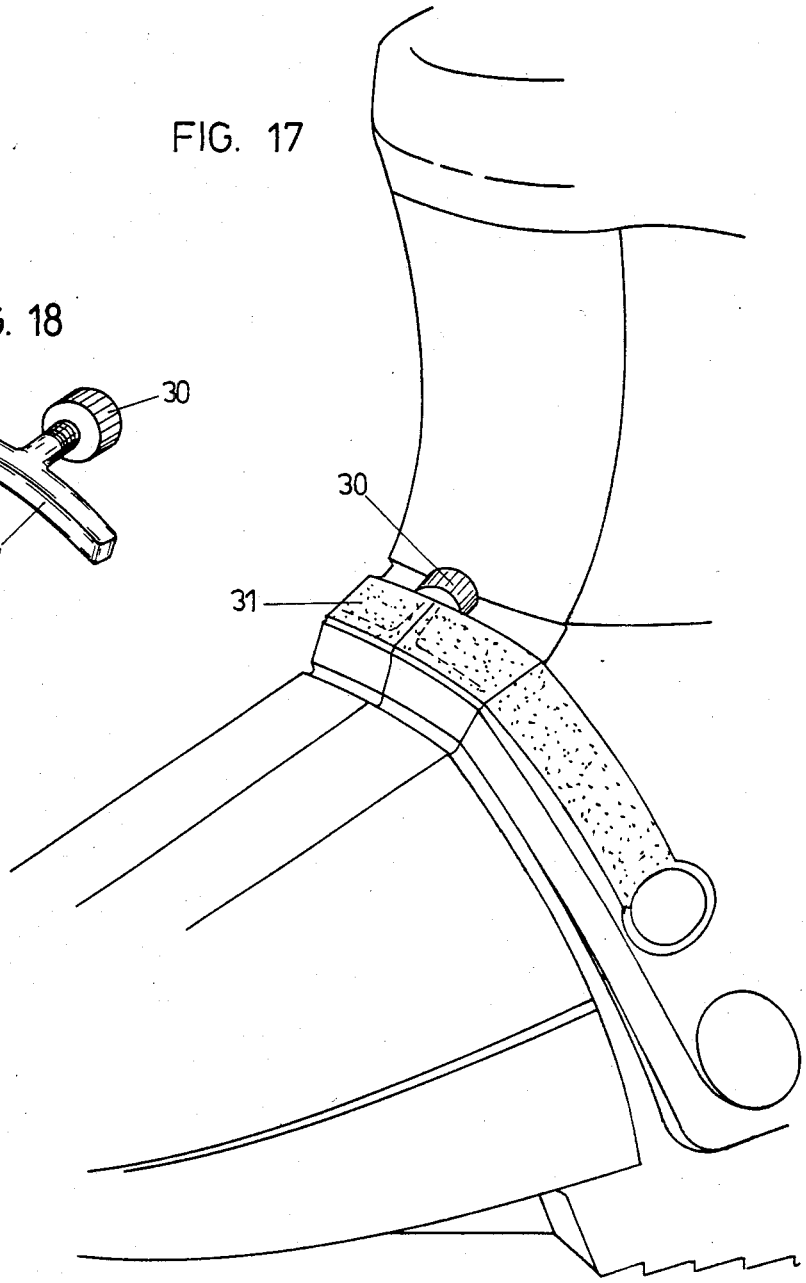

FIG. 21
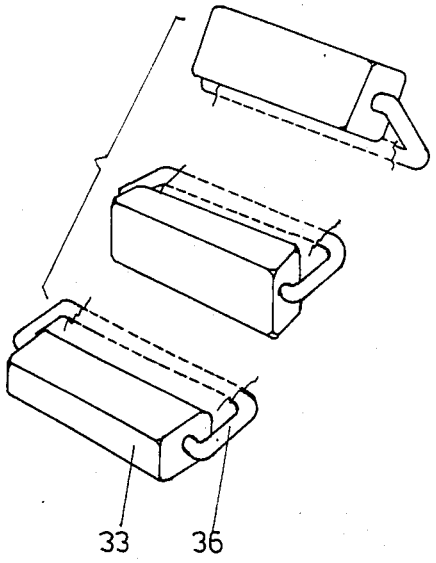
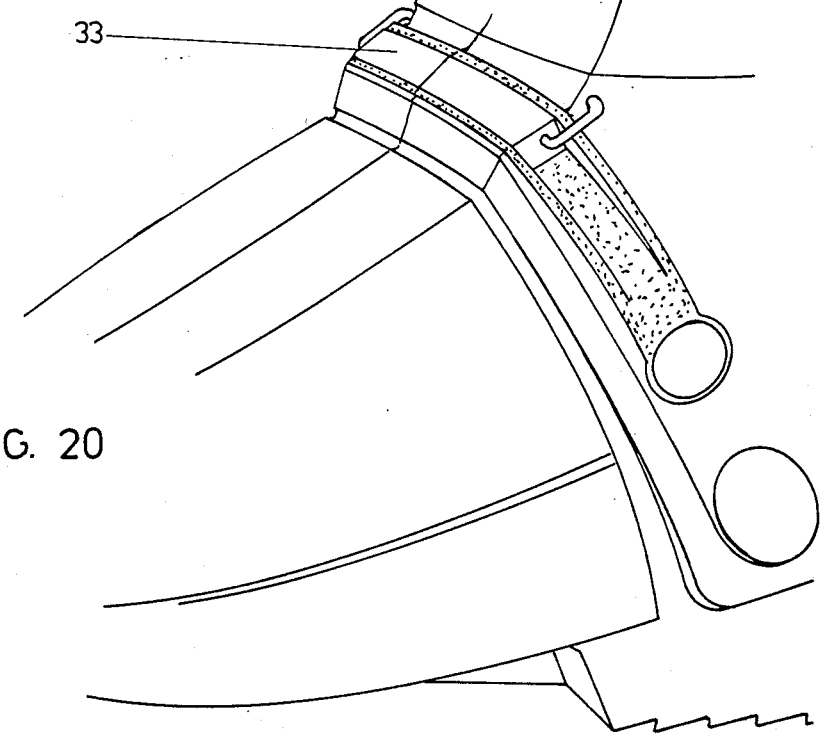
FIG. 20

SKI BOOT

BACKGROUND OF THE INVENTION

1. Field of the Invention

The invention refers to a ski boot comprising a shell consisting of synthetic plastics material and a shaft or cuff, respectively, swivellable relative to the shell and engaging, when being swivelled in direction to the boot tip, with its end portion facing the boot tip, the shell, in particular a protrusion thereof, the shaft or cuff, respectively, comprising at least one recess, groove or perforation extending transversely relative to the longitudinal direction of the boot.

2. Description of the Prior Art

With such ski boots it is already known to design the front edge, facing the boot tip, of the shaft as a stop face, which can, during a swivelling movement in direction to forward lean, come in operative connection with a corresponding counter-stop provided on the shell. It is further known to provide the cuff with grooves or ribs for influencing in this manner the flexibility within the front area. Finally, there were proposed attenuating inserts between the front edge of the cuff and the counter-stop on the shaft for preventing any hard impingement of the swivellable shaft portion on the shell.

From U.S. Pat. No. 4,455,768 to Solomon, there has become known a construction of a shaft in which the front end portion has adjusting elements for providing adjustability of the stiffness and bending properties. In this known construction, a bendable element was either tensioned as a tension chord around the surface of the shell or was connected with the shell. When designing the bending elements as flexible elements placed onto the shell, additional anchoring means on the shell are required, which anchoring means increase the risk of fracture of the shell at the anchoring locations. When designing the bending element as an integral part of the cuff, compromises relative to the swivellability of the cuff had to be put up with. The adjusting elements formed of sliding elements had, for being secured against becoming lost, substantially to extend beyond the slot provided in the cuff at both edges of the slot. Furthermore, the cuff has a more or less pronounced tendency to become, during an attenuated movement in direction to forward lean, lifted off the shell and to become expanded relative to the shell in dependence on the adjusted position of the adjusting element, which impairs the tightness of the boot.

SUMMARY OF THE INVENTION

Now, the invention aims at providing a simple and reliable construction of a ski boot of the initially mentioned type, in which any desired supporting elements may be secured in their respective position and in which any expansion of the cuff during swivelling movement in direction to forward lean is reliably avoided. For solving this task, the invention essentially consists in that carrier elements, in particular inserts having rubber-elastic properties, are inserted into the recess, groove or perforation and in that rigid supporting elements can be inserted into this recess, groove or perforation and be fixed in their position. On account of carrier elements, in particular inserts having rubber-elastic properties, being inserted into the recess, groove or perforation, it is possible to insert any desired supporting elements such that they can be fixed in their respective position without requiring that the edges of a slot must be overlapped for a substantial extent. Furthermore, by providing carrier elements, it is made sure that the supporting elements remain in their position even if the cuff is subjected to deforming forces. Anchoring of the carrier elements can, in this case, and in a particularly advantageous manner, be effected such that the carrier elements are connected with the shell at the lateral edges of the recess, groove or perforation, which results in the advantage that the connecting link between the carrier elements and the shell can simultaneously be utilized as a tension anchor preventing expansion of the cuff relative to the shell. For this purpose, the construction is advantageously such that the connecting link between the carrier elements and the shell is provided by at least one cap screw or rivet extending through the cuff or shaft, respectively, the cap of which extends over the outer surface of the cuff or shaft, respectively, and the enlarged foot portion of which extends over an elongated slot of the shell at its inner surface.

In this case, the rigid supporting elements can be connectable with the carrier elements and the inserts, having rubber-elastic properties, in a form-locking manner. For preventing any undue compromises with respect to the swivellability of the cuff and for simultaneously providing the possibility to exactly limit the angle of angular movement of the cuff relative to the shell, the swivelling axis and the connecting points between the carrier elements and the lower portion of the shell are different one from the other. It is just for this reason that in the shell the elongated slot is provided through which extends the cap screw or rivet, respectively, noting that, as is preferred, the longitudinal axis of the elongated slot extends along an arc and along the circumference of a circle having its center located in the swivelling axis of the shaft or cuff, respectively. Such provision of an arcuated elongated slot provides the possibility to adapt the longitudinal dimension of the elongated slot in correspondence with the admitted angle of angular movement of the cuff or shaft, respectively, relative to the shell and to obtain in this manner a limitation of the swivellability.

Any expansion of the cuff when swivelling it relative to the shell is reliably prevented if the cap screw or, respectively, the double-headed rivet is designed as a tension anchor making sure that the predetermined distance is maintained.

In an advantageous manner, the rigid supporting elements embrace at least partially the carrier element. On account of the carrier element being, as may be the case, maintained within the recess, perforation or groove, the supporting elements can, in this manner, exactly be positioned in a simple way. The supporting elements can, in a manner known per se, be designed as sliding elements. In an advantageous manner, the rigid supporting elements may extend over the perforation, groove or recess at the outer surface of the boot. This further contributes against the expansion of the cuff. In this case, any gripping behind at the inner surface of the boot can be renounced, so that the swivellability is not the least impaired by the frictional properties of the cuff and friction between cuff and shell, respectively.

The supporting elements can exactly be positioned in particular if the supporting elements can be inserted into recesses or perforations of the carrier elements formed of elements having rubber-elastic properties.

A still further adjustability of the stiffness and bending properties with simultaneous limitation of the swivellability can be obtained if at least one supporting element is arranged for being adjustable in transverse direction relative to the longitudinal direction of the perforation, groove or recess. Such a construction can be realized in a simple manner if the supporting element is formed of a stop member being shiftable on a threaded spindle and being maintained in its rotated position and having, as seen in longitudinal direction of the spindle, a smaller dimension than the inside width of the perforation, groove or recess. For actuating such a supporting element, a threaded spindle can be fixed to one end of a flexible shaft having its other end supported within a recess of the cuff and connected with a knurled knob.

In such an embodiment, the carrier element is preferably U-shaped, so that the supporting element can be supported for being shifted within the inner cross section of the U. It is of advantage if the U-shaped carrier element is designed as a damping element, in particular as a damping element of elastomeric synthetic plastics material, and at least partially embraces the supporting elements.

All previously mentioned supporting elements can advantageously also be used in an embodiment in which the recess is arranged between the end portion of the shaft and the protrusion of the shell, noting that at least one supporting element is arranged within this area. In particular in the last mentioned embodiment, a separate slot or recess, respectively, in the cuff can be omitted because the distance between the bottom edge of the cuff and the protrusion of the shell is at disposal for accommodating a supporting element. In such an embodiment, the supporting element is, in an advantageous manner, shiftable and/or adjustable with respect to its active width. For adjusting the active width of a supporting element, it is, in a simple manner, possible to select a triangular or trapezoidal cross section of the supporting element, the supporting element extending into the slot, recess, groove or perforation with a triangular point or with the small edge of the trapeze parallely extending to the basis of the trapezoid and being adjustable in direction of the depth of the slot or in direction of the height of the slot, respectively, and in particular being applicable against the slot, groove, recess or perforation. A further possibility for changing the active width of the supporting element consists in that the supporting element is designed as a toggle joint, the preferred arrangement being such that the supporting element is designed as a spring leaf being tensionable by means of a spindle. When rotating the spindle, the spring leaf is tensioned or relaxed, noting that on tensioning the spring leaf the active width is increased and when relaxing the spring leaf the width of the supporting element is reduced in direction of the path at disposal, i.e. in direction of the width of the slot, groove, gap or recess.

The arrangement can, however, also be such, that the supporting element is designed as an element of rectangular cross section. Such an element of rectangular cross section has, in principle, two different edges and can, for obtaining different width, be inserted along its small edge or its long edge. Advantageously, the element of rectangular cross section is linked for rotation around its axis and is insertable in both rotational positions into the slot, recess, groove or perforation for rotation about a further axis.

BRIEF DESCRIPTION OF THE DRAWING

In the following, the invention is further illustrated with reference to embodiments shown in the drawing.

In the drawing

FIG. 5 shows a modified construction in a representation similar to that of FIG. 3, FIGS. 6 and 7 show insert pieces for the carrier element in FIG. 5, FIG. 8 shows a modified embodiment of an anchoring part for the carrier element, FIG. 11 shows a modified embodiment in a representation like that of FIG. 3, FIG. 12 shows a carrier element for the embodiment according to FIG. 11, FIG. 13 shows a rigid supporting element for a carrier element according to FIG. 12 or 11, respectively, FIG. 17 shows a perspective representation of the arrangement fixed within the boot and this analogous to FIG. 16, FIG. 18 shows a perspective representation of the supporting member for the embodiment according to FIG. 17, FIG. 20 shows a swivellable and rotatable supporting element in its position on the boot, FIG. 21 shows the element according to FIG. 20 in its different rotated positions.

DETAILED DESCRIPTION OF THE PREFERRED EMBODIMENTS

Figure 1:
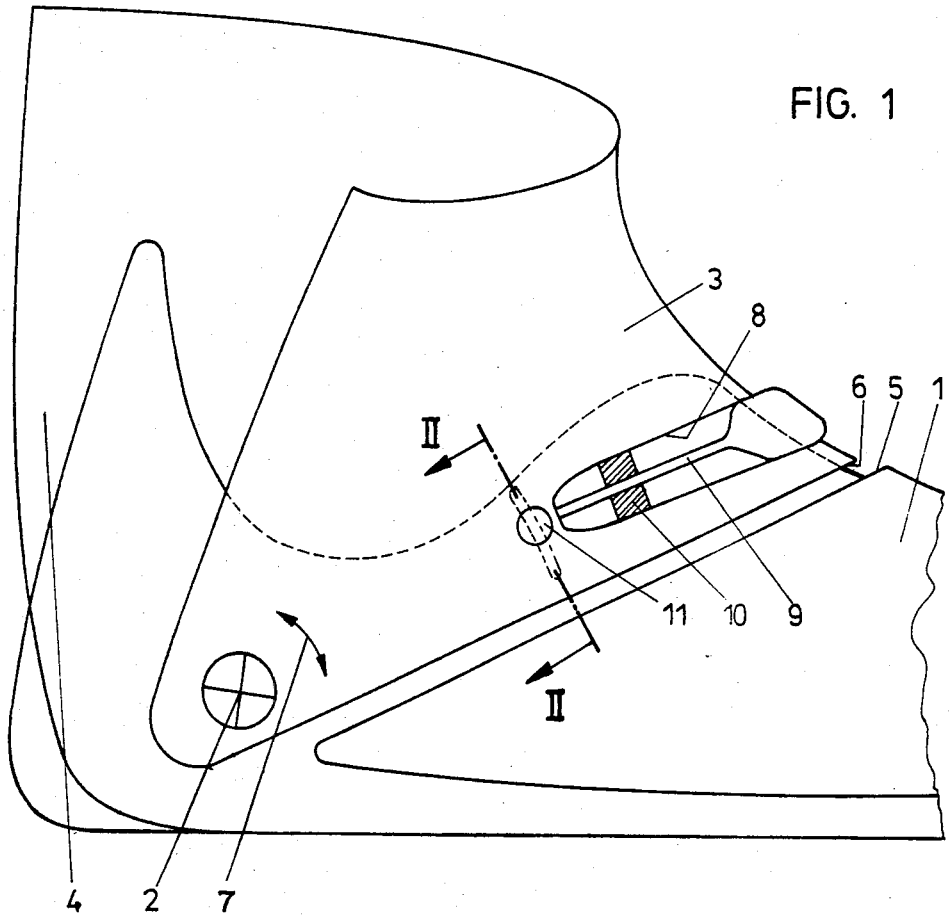
FIG. 1 schematically shows a partial view of a boot according to the invention.

In the embodiment according to FIG. 1, the shell of a ski boot is designated by 1. A cuff 3 is pivotally linked to this shell for being swivellable about a swivel axis 2. There is further schematically indicated a downwardly tiltable rear spoiler 4, which equally can be pivotally linked for being swivelled around the swivel axis 2.

Figure 2:
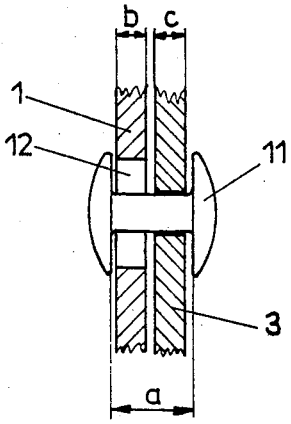
FIGS. 2 shows a section along line II—II of FIG. 1.

The shell 1 has a step 5 acting as a stop member for the bottom edge 6 of the cuff 3. When swivelling the cuff 3 in the sense of the arrow 7, the bottom edge 6 of the cuff 3 can come in active engagement with the counter stop 5, whereby the forward lean is limited. Within the lower area of the cuff, there is provided a slot 8, within which is arranged a carrier element 9 for supporting elements 10. The supporting elements 10 can be shifted in longitudinal direction of the carrier element 9 and be fixed in there just occupied position, so that the bending properties of the cuff can be adjusted within broad limits. The carrier element 9 is connected with the shell 1 by means of a fixing rivet 11. The type of this connection is more clearly shown in FIG. 2. The rivet 11 is designed as a double-headed rivet and extends over the internal surface of the shell 1, noting that an elongated slot 12 is provided in the shell 1. The longitudinal dimension of this elongated slot 12 may follow a curved line as is shown in FIG. 1, noting that the curvature essentially corresponds to the swivelling radius and the swivelling center located in the axis 2. Furthermore, the double-headed rivet is designed as a tension anchor and the mutually facing internal surfaces of the rivet heads are arranged one from the other at a distance a which is only minimally greater than the thickness b of the shell 1 and c of the cuff 3, respectively.

In this manner, any expansion of the shell is prevented on occasion of a deformation of the slot 8 at this location.

Figure 4:
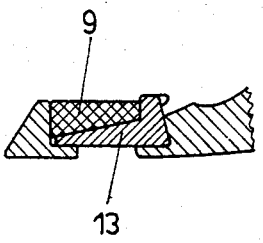
FIG. 4 shows a section along line IV—IV of FIG. 3.
Figure 3:
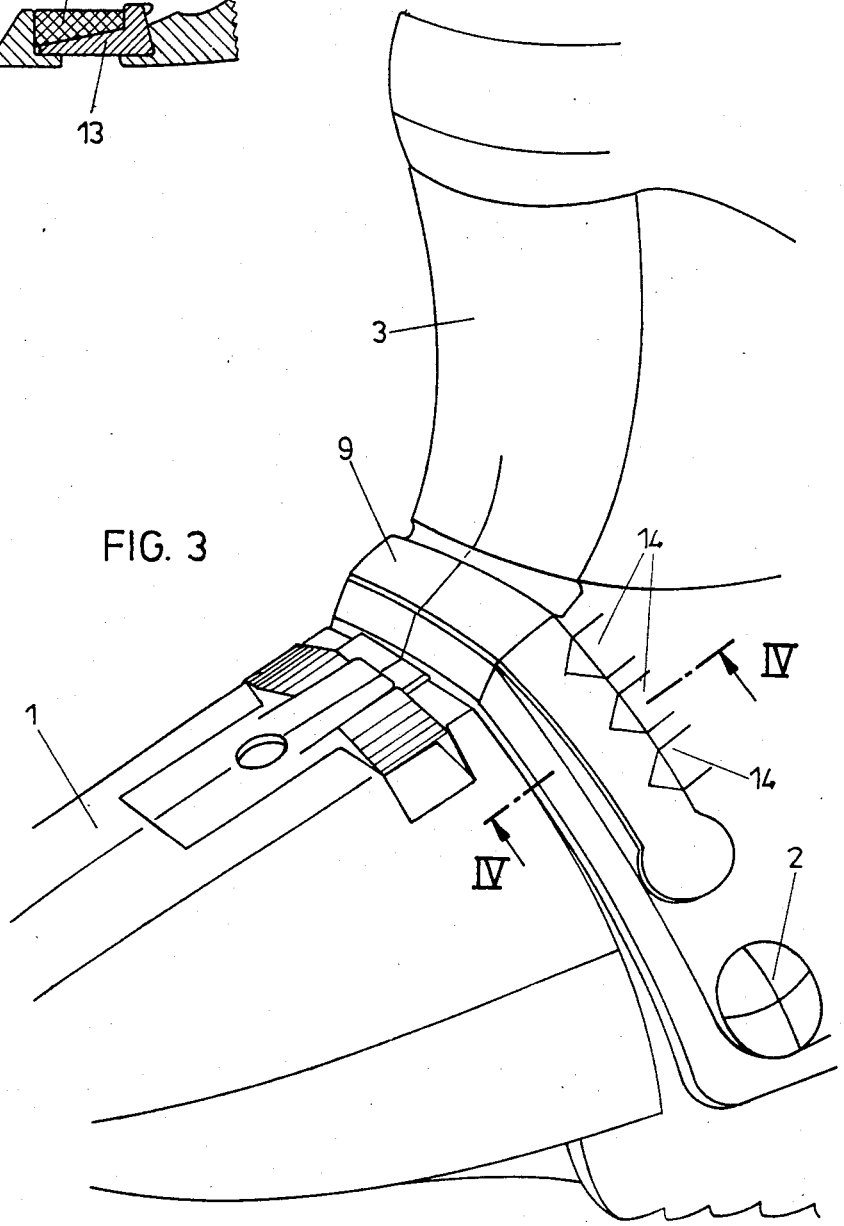
FIG. 3 shows a perspective partial view of a modified embodiment.

In the embodiment according to FIG. 3, the carrier element 9 is designed as a tape having rubber-elastic properties and being provided with recesses into which are shiftably insertable wedges 13 as is shown in FIG. 4. The corresponding positions are predetermined on the cuff 3 by grooves 14, noting that in dependence on the position of the wedges 13, which are designed as relatively dimensionally stable rigid supporting means, the cuff 3 is given a more or less stiff flexure characteristic.

In the embodiment according to FIG. 5, the carrier element 9 has perforations 15 into which can be inserted rigid supporting elements 16 or 17, respectively, as are shown in FIGS. 6 and 7. The rigid supporting elements 16 may, like the rigid supporting elements 17, be formed of different hardness, so that by interchanging individual elements of these elements different stiffness characteristics and different bending behavior, respectively, of the cuff 3 can be obtained.

FIG. 8 shows a cap screw 18 suitable for fixing in position in a simple manner the carrier element 9, so that interchanging of such elements is facilitated. Such a cap screw 18 replaces together with a cap nut the double-headed rivet 11 of FIG. 2 and facilitates interchangeability of the carrier element together with the rigid supporting elements.

Figure 9:
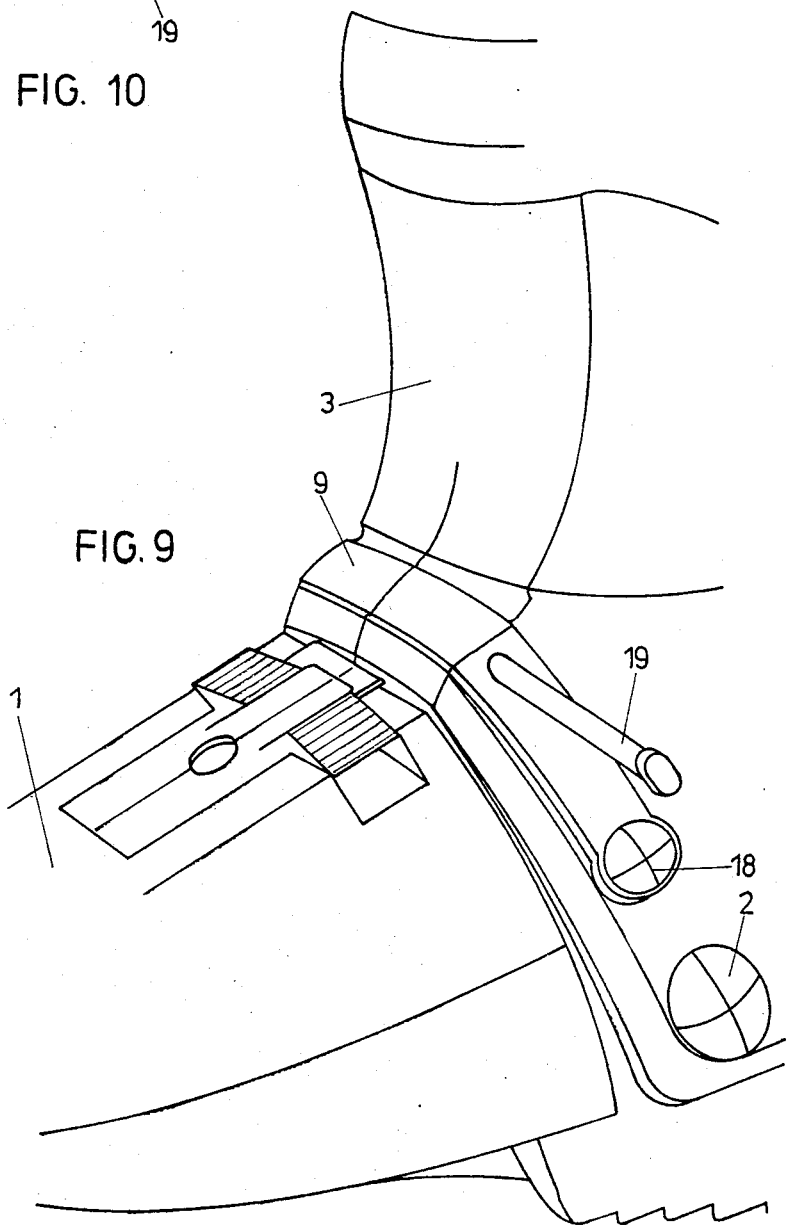
FIG. 9 shows a modified embodiment in a representation like that of FIG. 3 or 5, respectively.

In the representation according to FIG. 9, there is provided a carrier element having laterally provided an inserting opening for a rigid supporting element 19. Such a rigid supporting element 19 is shown in FIG. 10 in an enlarged scale, noting that the elastically deformable head 20 of this element secures its inserted position within the recess of the carrier element 9.

Figure 10:
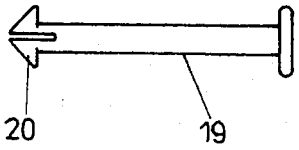
FIG. 10 shows a rigid supporting element for the embodiment according to FIG. 9.

An embodiment analogous to the embodiment according to FIGS. 9 and 10 is shown in the FIGS. 11, 12 and 13. In this case, there is inserted into the carrier element 9, having a substantially rectangular tunnel cross section 21, a rigid supporting member 22 of differing hardness or thickness.

Figure 15:
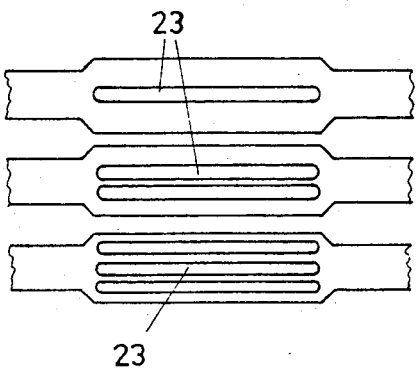
FIG. 15 shows different carrier elements firmly connected with rigid members and intended for the embodiment according to FIG. 14.
Figure 14:
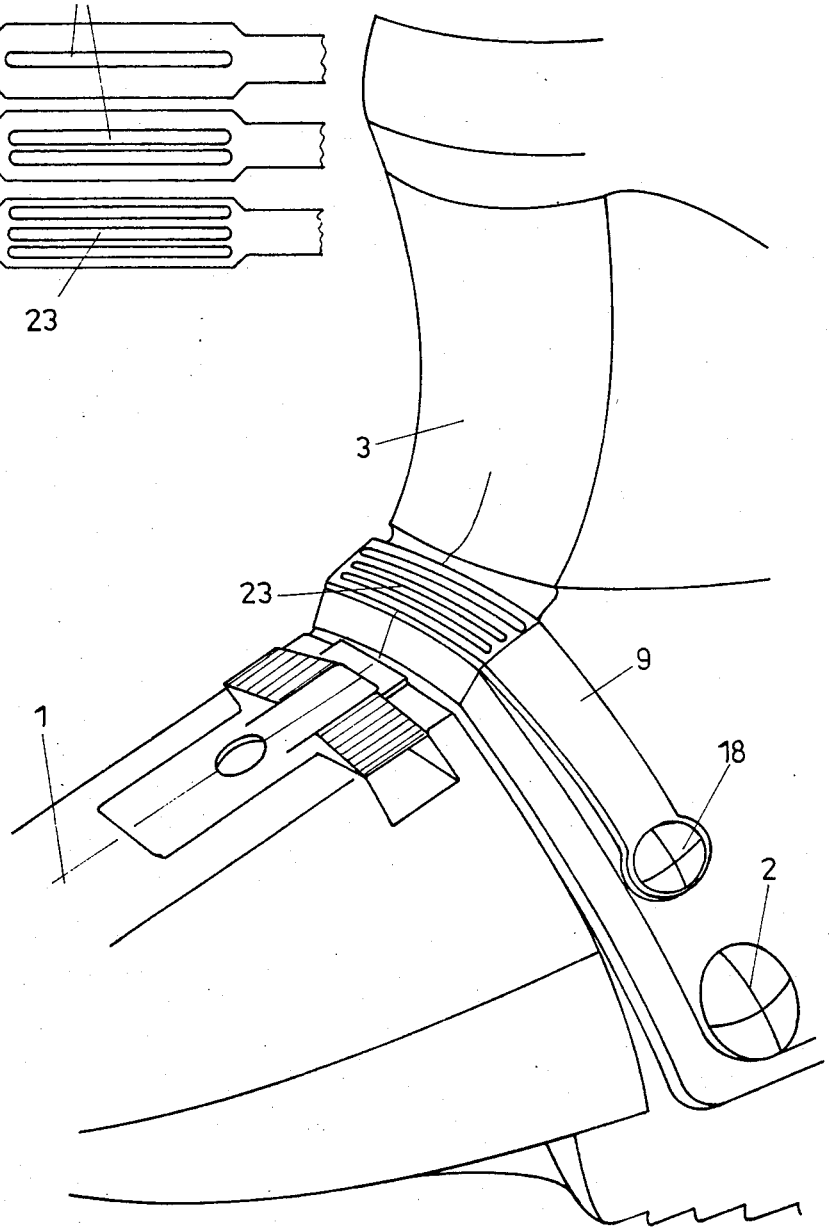
FIG. 14 shows a modified embodiment in a representation like that of FIG. 3.

In the embodiment according to FIGS. 14 and 15, rigid supporting elements 23 are integrally connected with the carrier element 9, noting that in dependence on the number of respective rigid supporting elements 23 provided in the central cross sectional area of the carrier element 9, there can be obtained different flexure properties. In this embodiment, the whole carrier element is interchanged for obtaining differing degrees of hardness or, respectively, differing degrees of bending elasticity, whereas in the previously mentioned embodiments it is sufficient to interchange the rigid supporting elements or to give them another position.

Figure 16:
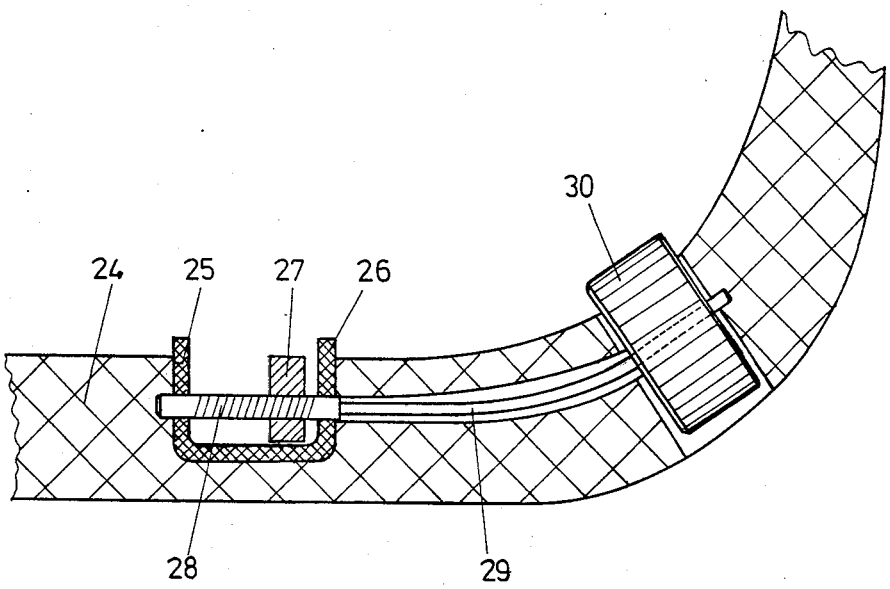
FIG. 16 shows a longitudinal section through part of the cuff of a boot and comprising a modified embodiment of the support.

FIG. 16 shows a longitudinal section through a front portion of the cuff. Within the cross section 24 of the material of the cuff there is provided within the front end portion a recess 25, into which is placed an U-shaped carrier element 26. Within the inside width of the cross section of the U-shaped carrier element 26, there is arranged a supporting element 27 for being shiftable transversely relative to the longitudinal direction of the groove 25, the respective shifted position being predetermined by a spindle 28. The spindle 28 is, via a flexible shaft 29, connected with a knurled nut 30, by means of which the supporting element 27 can be adjusted.

In the embodiments according to FIGS. 17 and 18, there is again shown the knurled nut 30 via which the supporting element 27, which is adjustable transversely relative to the slot, can be adjusted in its position. The arrangement according to FIG. 17 is covered by an elastic element 31 extending above the supporting element.

Figure 19:
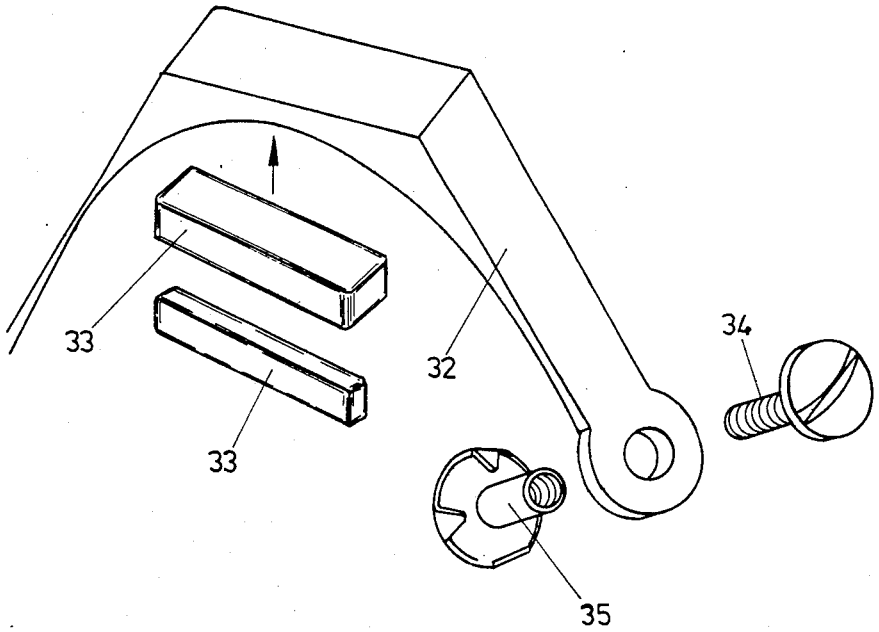
FIG. 19 shows a further modification of a further supporting element together with an associated carrier element.

In the embodiment according to FIG. 19, the carrier element 32 houses a supporting element 33, which can be placed into the carrier element 32 from its lower side in various rotated positions, edgewise or transversely. In this case, the supporting element 33 has substantially rectangular cross section. The carrier element 32 is again mounted by means of an axis guided with an elongated slot, for which purpose there are provided a threaded bolt 34 and a nut 35 comprising a bushing.

In the embodiments according to the FIGS. 20 and 21, the supporting element 33 of substantially rectangular cross section is swivellably linked to the cuff by means of a bracket 36 and is rotatable around its longitudinal axis as can be taken from FIG. 21. In dependence on the selected rotated position, there becomes effective either the short edge or the long edge of the supporting element 33, whereby the supporting properties can be changed.

Figure 22:
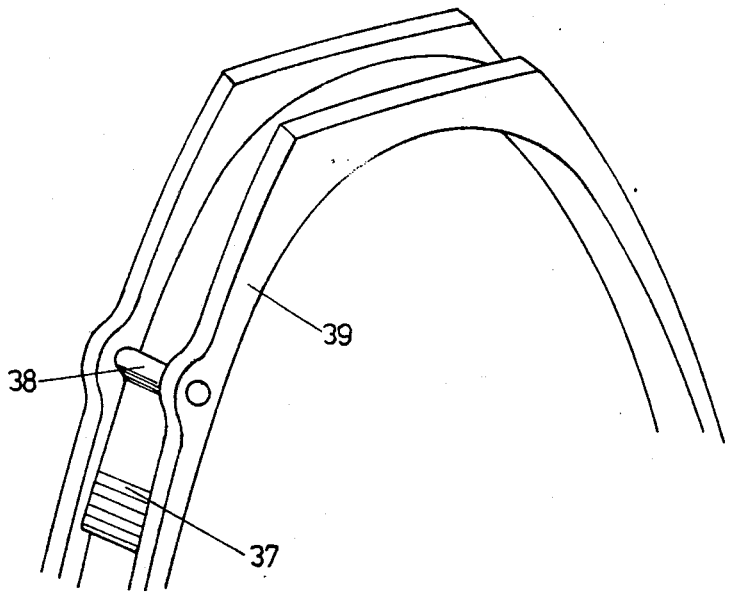
FIG. 22 shows a swivellable supporting element on a carrier element.
Figures 23, 24:
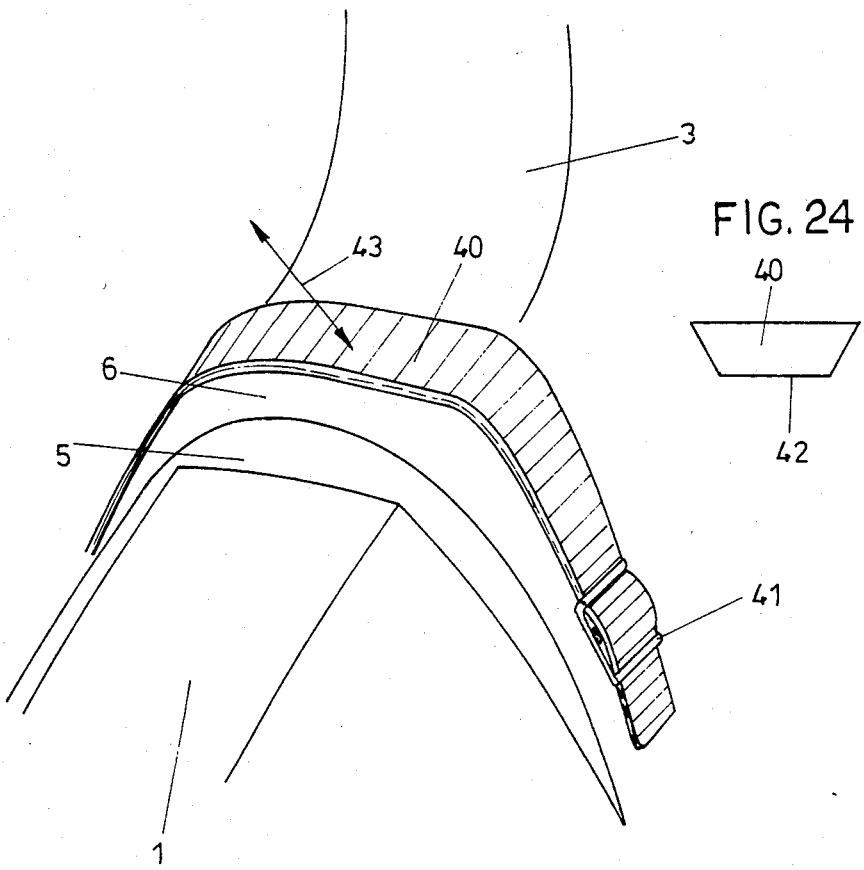
FIG. 23 shows a further embodiment of a supporting trapezoidal tension element arranged on the boot and in a schematic view.
FIG. 24 shows a cross-sectional view of the supporting trapezoidal tension element shown in FIG. 23.

In FIG. 22, a supporting element 37 is held within a carrier element 39 for being swivellable about an axis 38. The supporting element 37 can be swivelled upward or downward which results in a different supporting characteristic. Finally, in the embodiment according to FIG. 23, there is provided a trapezoidal tension member 40 which can by means of a tightening buckle 41 be moved into or out of a slot, a perforation or a groove, noting that the narrower side 42 of the supporting element 40 is inwardly directed. Adjustment thus corresponds to lifting or lowering this narrower edge 42 in the sense of the twin arrow 43, which equally results in an adjustment of the active width of the supporting element, because the lateral edges of the trapezoid diverge in outward direction. Of course, the same applies for a supporting element having triangular cross section.

All of the previously mentioned supporting elements can be arranged without difficulty (in a manner not illustrated bv the drawing) within the slot or gap, respectively, between the lower edge, designated by 6 in FIG. 1, of the cuff 3 and the protrusion 5 of the shell 1, which equally provides the possibility to change the damping properties and the flexure properties.

What is claimed is:

1. Ski boot comprising a shell (1) consisting of synthetic plastics material and a cuff (3), respectively, being swivellable relative to the shell and engaging, when being swivelled in direction to the boot tip, with its end portion (6) facing the boot tip, the shell (1), and the cuff (3), respectively, comprising at least one of a slot and a recess (8, 25) extending transversely relative to the longitudinal direction of the boot, characterized in that a front end of the cuff (3) shall always engage a protrusion (5) of the shell (1), carrier elements (9, 26, 31, 32, 39) in particular inserts having rubber-elastic properties, are inserted into one of the slot and the recess (8, 25) and in that rigid supporting elements (10, 13, 16, 17, 19, 22, 23, 27, 33, 37, 40) can be inserted into this one of the slot and the recess (8, 25) and be fixed in their position.

2. Ski boot as claimed in claim 1, characterized in that the rigid supporting elements (10, 13, 16, 17, 19, 22, 23, 27, 33, 37, 40) can be connected in a form-locking manner with the carrier elements (9, 26, 31, 32, 39) or the inserts having rubber-elastic properties, respectively.

3. Ski boot as claimed in claim 1, characterized in that the carrier elements (9, 31, 32, 39) are connected with the shell (1) at the lateral edges of the slot (8).

4. Ski boot as claimed in claim 3, characterized in that the connection between the carrier elements (9, 31, 32, 39) and the lower shell portion is provided by at least one cap screw or rivet (11, 18, 34, 35) extending through the cuff (3), respectively, the cap of which extends over the outer surface of the cuff (3), respectively, and the enlarged foot portion of which extends over an elongated slot (12) of the shell (1) at its inner surface.

5. Ski boot as claimed in claim 1, characterized in that the longitudinal axis of the elongated slot (12) extends along an arc and along the circumference of a circle having its center located in the swivelling axis (2) of the cuff (3), respectively.

6. Ski boots as claimed in claim 1, characterized in that the cap screw (18) or the double-headed rivet (11), respectively, is designated as a tension anchor.

7. Ski boot as claimed in claim 1, characterized in that the rigid supporting elements (10) embrace the carrier element (9) as least partially.

8. Ski boot as claimed in claim 1 characterized in that the longitudinal dimension of the elongated slot (12) corresponds to the admitted angle of swivelling movement of the cuff (3), respectively, relative to the shell (1).

9. Ski boot as claimed in claim 1, characterized in that the rigid supporting elements (10,19,22) are designed as sliding elements.

10. Ski boot as claimed in claim 1, characterized in that the rigid supporting elements (10, 13) extend beyond the slot (8) at the outer side of the boot.

11. Ski boot as claimed in claim 1 characterized in that the rigid supporting elements (10,13,16,17, 19, 22, 23, 33) can be inserted into recesses or perforations of the carrier elements (9, 32) formed of elements having rubber-elastic properties.

12. Ski boot as claimed in claim 1, characterized in that at least one supporting element (10) is supported for being adjustable transversely relative to the longitudinal direction of the slot (8).

13. Ski boot as claimed in claim 1 characterized in that the supporting element is formed of a stop member (27) being shiftable on a threaded spindle (28) and being held in its rotated position and having, as seen in longitudinal direction of the spindle (28), a smaller dimension than the inside width of the recess (25) (FIG. 16).

14. Ski boot as claimed in claim characterized in that the threaded spindle (28) is fixed to one end of a flexible shaft (29) having its other end supported in a recess of the cuff (3) and connected with an actuating knurled nut (30).

15. Ski boot as claimed in claim 1 characterized in that the carrier element (26) is of U-shape.

16. Ski boot as claimed in claim 1 characterized in that the U-shaped carrier element (26) is designed as a damping element, in particular a damping element of elastomeric synthetic plastics material, and extends at least partially beyond the supporting elements.

17. Ski boot as claimed in any of claim 1 characterized in that at least one supporting element (33) is adjustable in its active width.

18. Ski boot as claimed in claim 1 characterized in that the supporting element is designed as an expandable toggle joint, in particular as a spring leaf which can be tensioned by means of a spindle.

19. Ski boot as claimed in claim 1, characterized in that the supporting element (40) has a triangular or trapezoidal cross section and extends into the slot (8) with a triangular point or the small edge of the trapezoid parallelly extending relative to the base edge of the trapezoid and can be adjusted in direction of the depth of the slot (8) and can, in particular, be tensioned against the slot (8).

20. Ski boot as claimed in claim 1 characterized in that the supporting element is designed as an element (33) of rectangular cross section, which is linked for rotation about its axis and which can be placed into the slot (8) in both rotated positions for being swivellable about a further parallel axis.

* * * * *